US010238917B1

(12) United States Patent
Kojayan

(10) Patent No.: US 10,238,917 B1
(45) Date of Patent: Mar. 26, 2019

(54) PROGRAMMABLE, GRAVITY BASED, VARIABLE FORCE/WEIGHT SYSTEM

(71) Applicant: Arto Kojayan, Dallas, TX (US)

(72) Inventor: Arto Kojayan, Dallas, TX (US)

( * ) Notice: Subject to any disclaimer, the term of this patent is extended or adjusted under 35 U.S.C. 154(b) by 155 days.

(21) Appl. No.: 15/237,593

(22) Filed: Aug. 15, 2016

(51) Int. Cl.

| | |
|---|---|
| ***A63B 21/00*** | (2006.01) |
| ***A63B 24/00*** | (2006.01) |
| ***A63B 71/06*** | (2006.01) |
| ***A63B 21/008*** | (2006.01) |
| ***A63B 21/062*** | (2006.01) |

(52) U.S. Cl.
CPC ..... *A63B 24/0087* (2013.01); *A63B 21/0087* (2013.01); *A63B 21/062* (2013.01); *A63B 21/154* (2013.01); *A63B 24/0062* (2013.01); *A63B 24/0075* (2013.01); *A63B 71/0686* (2013.01); *A63B 2024/0093* (2013.01)

(58) Field of Classification Search
CPC ..... A63B 24/0087; A63B 21/0087; A63B 71/0686; A63B 24/0062; A63B 21/154; A63B 21/062; A63B 24/0075; A63B 2024/0093
See application file for complete search history.

(56) References Cited

U.S. PATENT DOCUMENTS

| | | | | |
|---|---|---|---|---|
| 5,059,089 A | | 10/1991 | Kocaoglan | |
| 5,329,215 A | * | 7/1994 | Fraser | G05B 19/186 318/603 |
| 5,791,452 A | * | 8/1998 | Reid | C03B 9/447 198/468.2 |
| 6,099,237 A | * | 8/2000 | Pfiffner | B23Q 7/04 414/744.3 |

* cited by examiner

*Primary Examiner* — Gary D Urbiel Goldner
(74) *Attorney, Agent, or Firm* — Michael Diaz

(57) ABSTRACT

A plurality of belt/pullet sets. Each belt/pulley set has a weight set. Each weight set is based on a formula of (2)n-power(X) where X is a basic weight and n is integral number for selecting a weight by a user. Each weight uses a different n-power. A carrier plate is utilized for bearing a weight set during a movement of an exercise. A clamping mechanism is utilized to couple each belt/pulley set to the carrier plate. In addition, the weight system includes an exercise device for a user to exercise, such as a bar or handle. A cable is coupled to the carrier plate, weight set, and the exercise device. In another embodiment, the formula may be utilized in a variable distance system or robotic arm where a plurality of cylinders moves an object, such as a travel arm.

3 Claims, 7 Drawing Sheets

PROGRAMMABLE, GRAVITY BASED, VARIABLE FORCE/WEIGHT SYSTEM

BACKGROUND OF THE INVENTION

Field of the Invention

This invention relates to exercise equipment. Specifically, the present invention relates to a gravity based, programmable, variable force/weight system.

Description of the Related Art

There are various types of existing gravity based weight lifting machines, basically divided into two groups, "free weights", and "exercise machines. With the gravity based weight lifting exercise machines, the user manually inserts a pin into a stack of weights on the machine in order to produce the desired force/weight needed for the selected exercise type. The stack of force/weights is guided by shafts and is restricted to move only in vertical motion. For the free weight machine, the user manually selects and places force/weights onto the bar of the machine. The bar with force/weight is not guided and it can move at the will of the user in any direction.

With both machine types, the user manually selects force/weight plates to create a resistive force to exercise and stress the muscles, to increase the heart rate, lung function and blood flow to the muscles until the user is gradually weakened by repetitive lifting and lowering of the preselected force/weight until the user is no longer capable of lifting the previous and manually selected force/weight plates.

Because both types of weight lifting machines cannot change the preselected force/weight level while the user is working with the machine and because the user is gradually getting weaker from lifting and lowering the preselected force/weight level and that level becomes too hard for the user to lift and lower the force/weight, the user eventually stops the exercise. This stoppage breaks the continuity of the exercise. When the user becomes tired and weakened by the repetitive lifting and lowering the weights, the user stops the exercise, thereby losing the benefit of continually exercising, stressing the muscles, maintaining the increased heart rate, lung function and blood flow thorough the muscles being exercised, which results in the stoppage of calories being burned.

A system is needed which provides a variable force or resistance by using weights in a more efficient and economical fashion. It is an object of the present invention to provide such a system.

SUMMARY OF THE INVENTION

In one aspect, the present invention is a variable force/weight system applicable to all types of exercise machines and other devices that require controlled gravity based force/weight management. The system includes a plurality of force/weight belt/pullet sets. Each belt/pulley set has an attached weight set. Each weight set is based on a formula of (2)n-power(X) where X is a basic weight and n is integral number for selecting a weight by a user. Each weight uses a different n-power. A carrier plate is utilized for bearing a weight set during a movement of an exercise. A clamping mechanism is utilized to couple each belt/pulley set to the carrier plate. In addition, the weight system includes an exercise device for a user to exercise, such as a bar or handle. A cable is coupled to the carrier plate and the exercise device.

The carrier plate has power activated electro-pneumatic valves 400 (either pneumatic or electric). The number of electro-pneumatic valves 400 is directly proportional to the number of the number of force/weight belt/pulley sets utilized in the system 10. The carrier plate is guided by a bearing set (bearings 302 and shafts 304) to keep the carrier plate stable and sturdy during the pushing or pulling actions of the exercise device (e.g., bar). The exercise bar may be attached to the carrier plate 20 via a belt or other coupling device. The belt is coupled to the carrier plate through a set of belt/pulleys to allow the user to lift the force/weight belt/pulley set either in pushing the exercise bar or pulling on the exercise bar. The actuators couple the selected force/weight belt/pulley sets to the carrier plate according to the user's force/weight selection based on the formula (2)n-power(X) where X is a basic weight in order to create the desired force/weight requirements of the exercise. As the user pushes and pulls on the exercise bar or the exercise handle, the cable pulls (in tension) and lifts the carrier plate and the coupled force/weight belt/pulley sets is lifted, thereby creating force resistance. When the force/weight set is lowered by the force of gravity, a force resistance is also created. Throughout the exercise motions, there is a resistive force present both in pulling and pushing motions of the user through the exercise bar or handle, transmitted through the belt. The belt is attached to the carrier plate 20 which couples the sets of force/weight belt pulley or additional belt-pulley sets as needed individually, collectively or in combination per the formula to generate the resistance force necessary to maintain muscle stress, increased heart rate, increased blood flow and increased breathing and lung function throughout the exercise routine.

In one aspect, the present invention is a multi-cylinder system for moving a travel arm. The multi-cylinder system includes several vertically aligned cylinders and a horizontal track system for moving the cylinders. In addition, the horizontal track system supports the vertically aligned cylinders. Each cylinder provides a different incremental distance for moving the travel arm, thereby providing an infinitely variable distance for moving the travel arm within a defined range. The travel arm and an attached robotic gripper may be positioned below the cylinders to provide an open area below the system.

DESCRIPTION OF THE INVENTION

Figure 1:
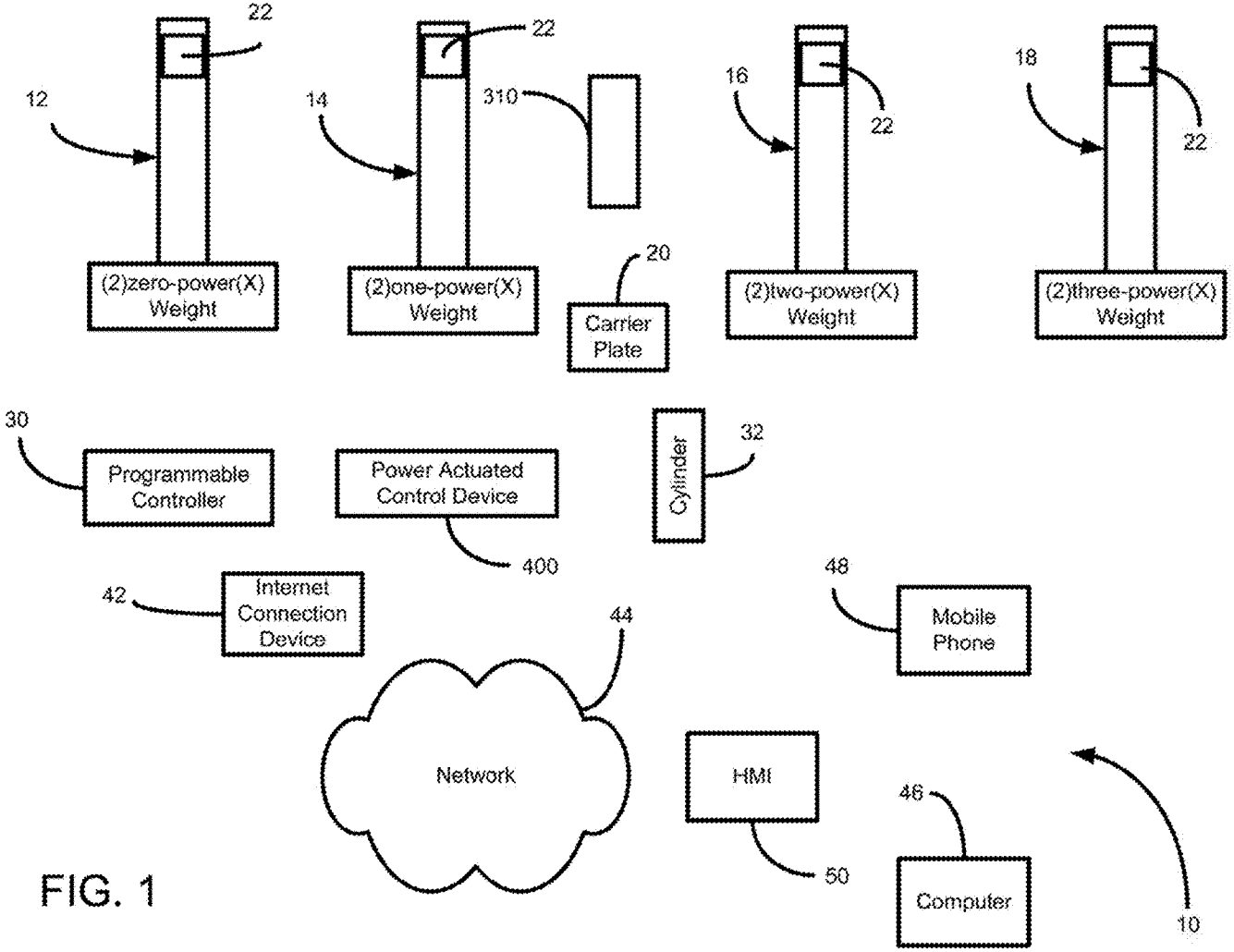
FIG. 1 is a simplified block diagram of the major components of the system.

The present invention is a gravity-based, variable force weight system. The present invention provides gravity based, variable force/resistance using actual weights to the user of a variable weight system 10. FIG. 1 is a simplified block diagram of the major components of the system 10. The system includes a plurality of force/weight belt/pulley sets including a belt/pulley set 12 having a weight (X) equaling (2) zero-power (X), a belt/pulley set 14 having a weight (X) equaling (2) one-power (X), a belt/pulley set 16 having a weight (X) equaling (2) two-power (X), and a belt/pulley set 18 having a weight (X) equaling (2) three-power (X). Although four belt/pulley sets are depicted in the following figures, it should be understood that the present invention may include any number of belt/pulley sets and still remain in the scope of the invention. Furthermore, additional belt/pulley sets with additional weight may be added to increase the force. For example, a belt/pulley set with a weight (X) equaling (2)fourth-power(X) and so on as desired. The system 10 also includes a carrier plate 20. Additionally, the present invention may utilize a plurality of guide bearings and shaft combinations 22 to move the weight along each belt/pulley set. The system 10 may also include a programmable controller 30 and electro-pneumatic valves 400, which may be actuated electrically, pneumatically or any other power source. The present invention may also utilize a plurality of electric or pneumatic cylinders 32. In one embodiment, the present invention may include an Internet connection device 42 for connecting to a network 44, a computer 46 or mobile phone 48 also connected to the network. Furthermore, the system 10 may be coupled to a Human Machine Interface (HMI) 50.

The present invention enables the variance of weight resistance. By selecting a previously entered program into the programmable controller 30 and accessing it through the HMI 50, a desired weight may be actuated according to the user's desired program, thereby providing a gravity based, variable force/resistance to the user.

Figure 2:
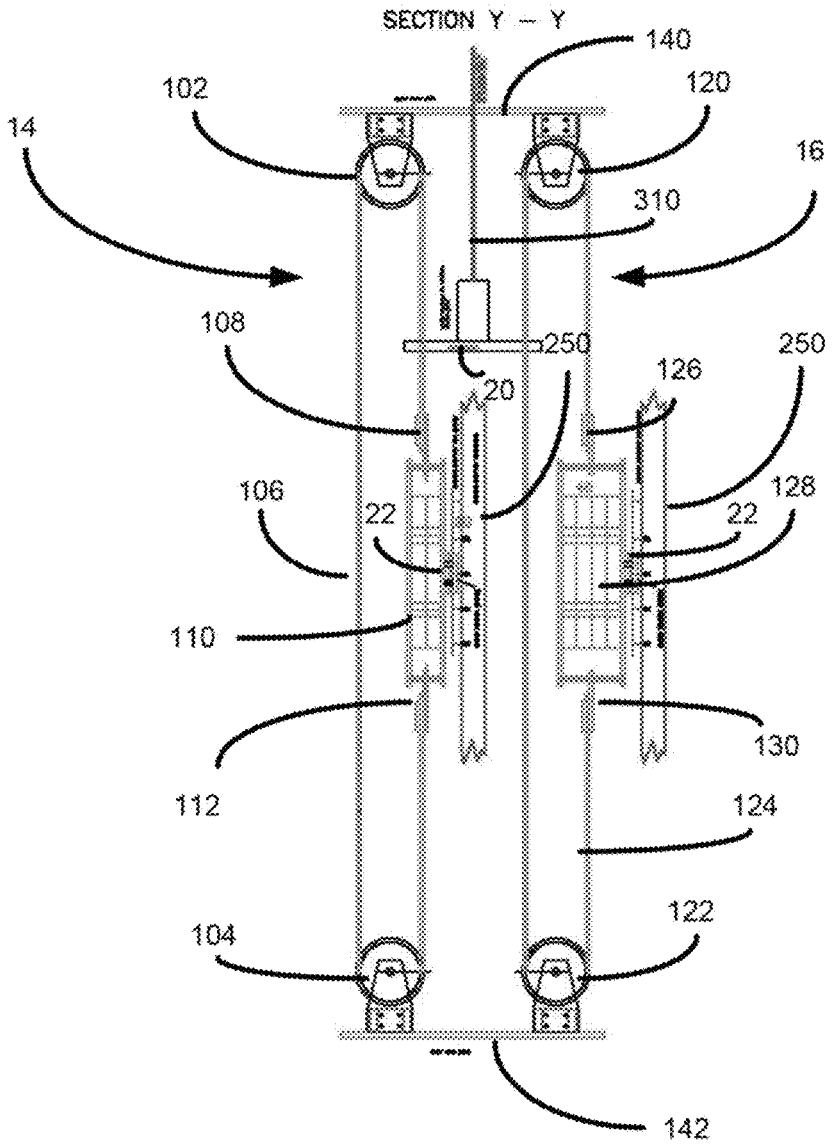
FIG. 2 illustrates a side view of a first belt/pulley set and second belt/pullet set in one embodiment of the present invention.

FIG. 2 illustrates a side view of the belt/pulley set 14 and belt/pullet set 16 in one embodiment of the present invention. The belt/pulley set 14 includes an upper pulley 102 and lower pulley 104. Wrapped around both pulleys is a belt 106. One end of the belt is attached to a top hook 108 which is attached to a weight set 110 equal to (2)one-power(X). An opposite end of the belt 106 is attached to a bottom hook 112 of the weight set 110. The belt with the weight set 110 goes through the carrier plate 20, a clamp mechanism 300, and cylinders 32 and is actuated by the electro-pneumatic valves 400. When X=10, the force is equal to 20. The second belt/pulley set 16 also includes an upper pulley 120 and a lower pulley 122 with a belt 124 wrapped around both pulleys. One end of the belt is attached to a top hook 126 of a weight set 128 equal to (2)two-power(X). An opposite end is attached to a bottom hook 130 of the weight set (2)two-power(X). The belt 124 also goes through the carrier plate 20, a damp mechanism 300, and cylinders 32 and is actuated by the electro-pneumatic valves 400. When X=10, the force is equal to 40. The upper pulleys are attached to an upper base plate 140 and the lower pulleys are attached to a lower base plate 142.

Figure 3:
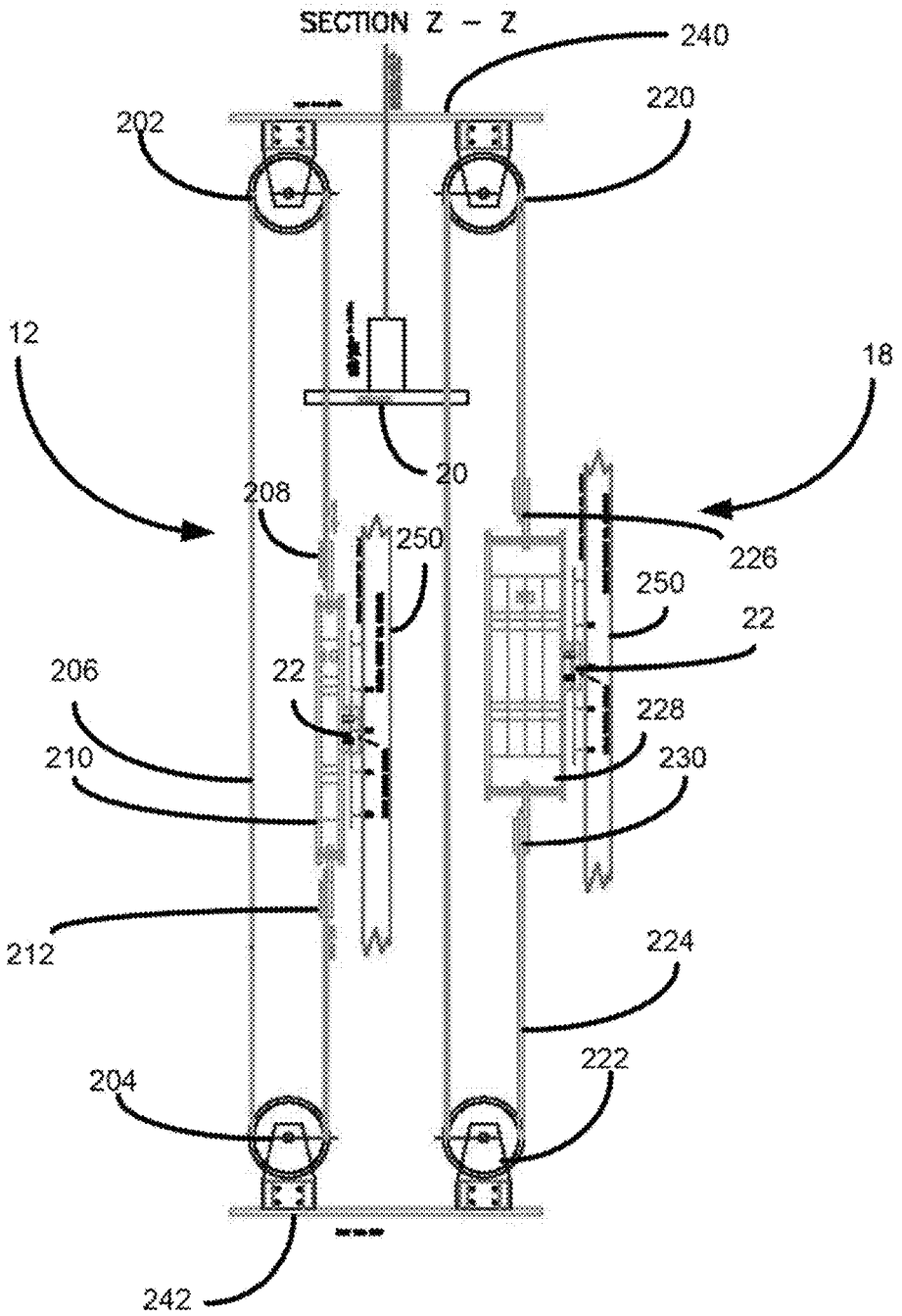
FIG. 3 illustrates a side view of a third belt/pulley set and a fourth belt/pullet set in one embodiment of the present invention.

FIG. 3 illustrates a side view of the belt/pulley set 12 and belt/pullet set 18 in one embodiment of the present invention. The belt/pulley set 12 includes an upper pulley 202 and lower pulley 204. Wrapped around both pulleys is a belt 206. One end of the belt is attached to a top hook 208 which is attached to a weight set 210 equal to (2)zero-power(X). An opposite end of the belt 206 is attached to a bottom hook 212 of the weight set 210. The belt with the weight set 210 goes through the carrier plate 20, a damp mechanism 300, and cylinders 32 and is actuated by the electro-pneumatic valves 400. When X=10, the force is equal to 10. The second belt/pulley set 18 also includes an upper pulley 220 and a lower pulley 222 with a belt 224 wrapped around both pulleys. One end of the belt is attached to a top hook 226 of a weight set 228 equal to (2)three-power(X). An opposite end is attached to a bottom hook 230 of the weight set (2)three-power(X). The belt 224 also goes through the carrier plate 20, a clamp mechanism 300, and cylinders 32 and is actuated by the electro-pneumatic valves 400. When X=10, the force is equal to 80. The upper pulleys are attached to an upper base plate 240 and the lower pulleys are attached to a lower base plate 242. In addition, in one embodiment, one or more guide bearing mechanisms 22 may be utilized to guide the weight set up and down (vertically). The guide bearing mechanisms may prevent the weight sets from rotation in the vertical axis.

Figure 4:
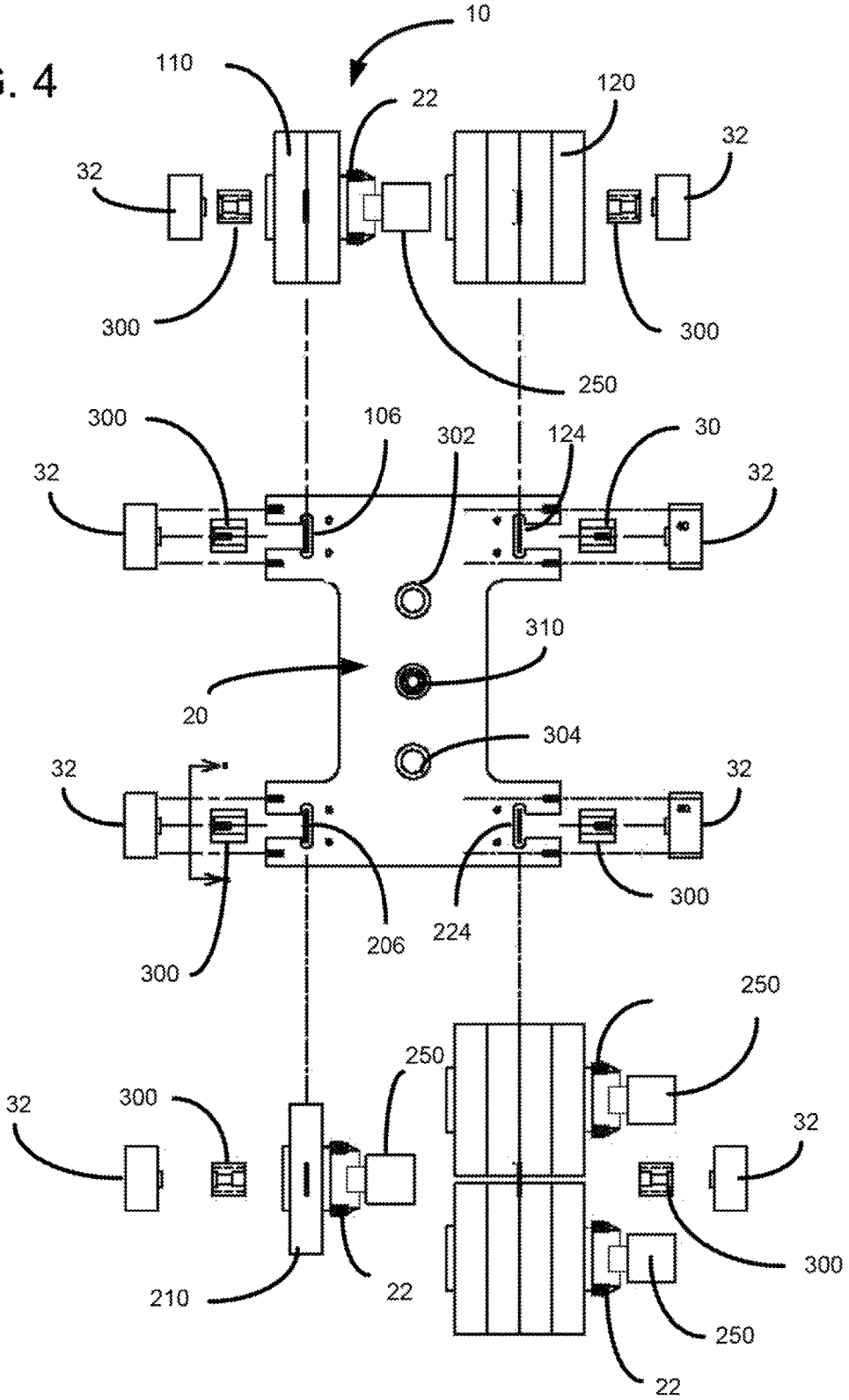
FIG. 4 illustrates a top view of the system, the carrier plate and the cylinders.

FIG. 4 illustrates a top view of the system 10. Each pulley/weight set belt goes through clamps 300 located on the carrier plate 20. According to a commend from the electro-pneumatic valves 400 controlled by the programmable controller 30, the clamp closes and locks the selected weight set onto the carrier plate when multiple actuators are selected. Thus, the carrier plate lifts weight according to the command from the programmable controller 30. The carrier plate 20 is guided by bearings 302 and bearing shafts 304 which is attached to the frame of the machine. The carrier plate has a central cable 310 which is attached to a final variable-force arm.

Figure 5:
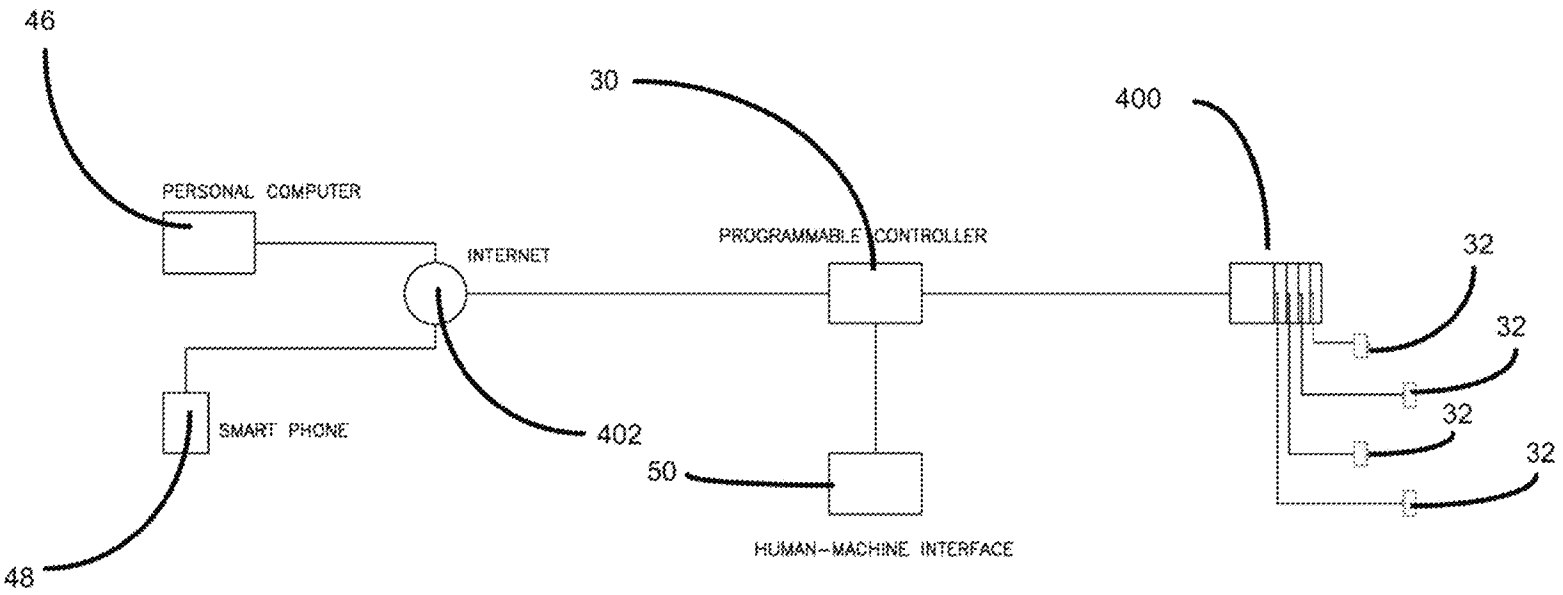
FIG. 5 is a simplified block diagram of various components of the system.

FIG. 5 is a simplified block diagram of various components of the system 10. The present invention may utilize a computer 46 or mobile phone 48 to send commands via the Internet 402 or network 44 to the programmable controller 30 through the HMI 50. The controller 30 may then send controls to an actuator 400, which may be powered by any source (e.g., pneumatically or electrically) to actuate the clamping mechanism 300 and cylinders.

As discussed above, the present invention may be utilized as a variable weight resistance machine. Although four belt/pulley sets are illustrated, the present invention may have more or less belt/pulley sets. Additionally, the present invention may utilize any number (N) power in the formula "(2)N-power(X)" for weight sets.

The present invention allows the user to exercise with the system 10 at the preselected force/weight level and monitor the user's exercise pace. The present invention may automatically detect if the user's pace is slowing-down and may automatically reduce the weight to a one "X" level lower value such that the user keeps on exercising at the same pace, stressing the same muscles longer with the new lower value force/weight. The user may then maintain the increased heart rate, lung functions, blood flow through the muscles and burn additional calories with substantial physical benefits. The present invention also allows the user to stress the muscles repetitively for a greater duration which increases the muscle size and definition.

In one embodiment, the user has the option to preprogram the machine for set number of repetitions with a given force/weight and stop and or set number of exercise sets and go onto the next exercise. In addition, the present invention may allow the user the option to bypass the system's ability to detect slower exercise pace and bypass the system's ability to shift to a lower force/weight. The user may then keep the same force/weight level but at slower motion pace. The bypass option may be activated by the user during the exercise period by pressing a first switch on the system and an indicator light is illuminated on the HMI 50 to indicate this feature is activated. The momentary switch may then signal the system's controller to bypass the automatic force/weight shifting mode. This feature is removed by pressing onto the same switch again and the illuminated light on the HMI is extinguished.

When the user begins an exercise routine on the system with a preset force/weight level and during the exercise period the user decides to increase the force/weight level, the user may press a momentary second switch on the system to increase the force/weight level by one "X". The second switch signals the system's controller to increase the force/weight by one "X". In another embodiment, the present invention may keep a record of the alteration to the preselected program and it can be reviewed at a later time for evaluation.

Both types of existing weight lifting machines, do not display onto a screen the exercise progress in real time or do not display progress at all such as proper, preselected exercise pace and rhythm, or the proper force/weight, which may present a potential for muscle injury. Existing weight lifting machines do not display how many reps have been completed or how many sets are completed, or how many calories are burned. In the present invention, the real time the exercise progress, pace, calories burned, heart rate in real time and other parameters listed above may be displayed in real time. Additionally, existing exercise machines are not capable of being remotely preprogrammed, store previous exercise routine force/weight selection, or determine how many repetitions were made by a user. The user relies on memory or a notebook of previous exercise parameters. However, in the present invention, the system may store the user's previous exercise parameters in its memory such that there is no relying on the user's memory of previous exercise parameters.

The present invention also allows the user or a professional trainer hired by the user to preprogram the system remotely such that upon the user's arrival to the machine, the user simply identifies itself to the system via an identifying means such as a membership card or a PIN number, whereby the system 10 recognizes the user and activates the preprogrammed exercise regiment designed for that particular user. The user may then commence the preprogrammed exercise routine while displaying the exercise parameters in real time onto the HMI screen.

In existing weight lifting machines, the user must employ a professional exercise trainer located at the machine to observe and guide the user of the proper force/weight needed for the exercise, to guide and direct the user if the user is pushing too hard or not hard enough, or maintaining the preselected pace or number of repetitions. Furthermore, existing exercise machines do not have the capability for a professional trainer to remotely design an exercise regiment for the user based on each user's own capability and need or store this exercise program into the machine such that when the user begins to use the machine to exercise, the machine guides the user through the professional trainer's preprogrammed exercise routine. Existing exercise machines also cannot store a user's exercise parameters to be reviewed at a later time to be critiqued and adjusted for the next exercise routine.

In addition, the present invention allows the professional trainer or the user to program the system 10 remotely prior to the user arriving to the system, store that exercise parameter remotely into the system's memory and once the user begins to exercise, the system may guide the user through the user's or trainer's preprogrammed exercise routine. The system 10 may also provide alerts via the HMI screen messaging if the user is staying within the limits of the user's or trainer's preselected program.

The present invention enables a trainer to remotely monitor the user's movements and remotely send messages to the user in real time in regard to the user's movements and display a message on the HMI for corrective action. Because the system may store the performance of the user's exercise parameters, the trainer or the user has the option to review the performance of the user at a later time by pulling the user's performance data from the system's memory or the server, make adjustments to the user's routing and reprogram the exercise routine such that upon user's next arrival to the system 10, the user will have new exercise parameters and message to exercise with.

The present invention may allow the user from a remote location to design an exercise routine of his choice consisting of selecting the desired force/weight, number of repetitions for the selected exercise and number of sets of the selected exercise to be completed.

In one embodiment, upon the user identifying himself to the system 10 through some type of identification mechanism, such as by swiping a membership card or entering a personal code onto the HMI, the system 10 may then recognize the user and the user's preselected exercise routine, which results in the system automatically selecting the predefined force/weight, exercise pace, number of repetitions and the user without needing the user to manually use a force/weight selecting pin to select the force/weight for the selected exercise.

In the existing lifting machine, when the user is at the free weight lifting machine, at times previous users of the same machine do not remove the free weights from the machine, which then requires the new user to unload the weights from the machine. At times the force/weights may be several stacks of 45 pound or 20 kilo plates each, or some other value totaling hundreds of weight units. Manually removing these force/weights may become unduly stressful to the new user and cause injury.

In the present invention, the system enables the user to enter his PIN or swipe a membership card or any other personal identifier. The system 10 may then recognize the new user, triggering a response from the system 10, such as deleting the previous user's exercise routine, entering the new user's exercise routine, selecting the preprogrammed force/weights according to the new user's routine. Thus, the present invention provides the added advantage of preventing the new user from loading or unloading force/weight plates onto or off the machines, thereby preventing personal injury to the user.

In one situation, the user, using an existing free weight machine, may attempt lifting a maximum or near maximum force/weight. In such an event, the user may become so fatigued that the user is unable to lift the weight bar back onto the weight bar hook, which can be hazardous to the user. The present invention reduces this crushing risk. When the user determines that it can no longer lift the force/weight away from the user, in one embodiment, the user may press a switch which locks and holds the motion of the bar, thereby allowing the user to escape from under the weight bar and preventing injury to the user.

In another embodiment, the present invention may automatically display a light on the HMI indicating the user is not maintaining the preselected pace. In this example, the system 10 may give the user a predetermined period to resume the preselected exercise pace. If the user is unable to resume the predetermined pace, then the system 10 may automatically lower the force/weight by one "X".

In another embodiment, the present invention may continuously monitor the movements of the user throughout the selected exercise duration and compare it to the preprogrammed parameters. The present invention may monitor if the user is reaching the full range of its travel motion. If the user is not reaching the proper exercise range of motion, the system may turn on a light on the HMI for corrective action by the user. The invention may also memorize the number of corrective action indicators illuminated and store this information on its memory for later review and corrective action. Furthermore, the present invention may be equipped with a commercially available heart rate monitor to monitor the heart rate of the user and the heart rate may be displayed on the HMI.

The user may work on the system 10 until the preprogrammed exercise duration and repetition is reached. If the user chooses to stop the exercise, the user may stop as desired. To prepare for the next exercise, the user may touch an indicator on the HMI screen to stop the present exercise routine.

Additionally, the user has the option to repeat the same exercise again as is or change the original force/weight parameters with a new force/weight parameter at the machine's HMI. Furthermore, the present invention may allow the user to randomly select a new exercise routine preprogrammed into the system's control systems from the HMI's displayed menu options. The may allow the user to change a new force/weight level right at the machine, a new repetition parameters or allow the user to bypass the preprogrammed routine and enable the user randomly and freely use the system. The control system of the system 10 may determine and display the duration of the exercise, how much force/weight was used and for what duration, number of repetitions completed with the selected force/weight, heart rate and calories burned.

The use of the system 10 will now be explained in one embodiment. First, when the user desires a work-out on the system 10, the user enters a PIN or a bar code or some other identifier required by the system 10 to identify the user. The system then recognizes the user and displays the user's name briefly for verification and provides an option of selecting a "previous routine" or a "new routine", as displayed as a message on the HMI. If the user desires to enter a new exercise routine or a routine with changes, such as new force/weight for an exercise or has changed the number of repetitions or the number of sets for that exercise, or has added a new exercise, the user then selects the "new" routine, otherwise the user selects to stay with the previous routine.

The system 10 may display all of the exercise routines for that user on the HMI. When the user chooses an exercise, the HMI displays the force/weight selected, the number of repetitions for each set, the number of sets for that exercise and the pace for each selected set for the exercise routine. The user may choose any exercise in a random order such as "chest exercise" or "leg extension" or "pull-downs" etc. The system 10 may monitor the preprogrammed pace of the user to ensure that the user is staying within set parameters. For example, where conducting a selected number of repetitions, if the user lags behind a predetermined pace, the system 10 may shift to one "X" lower weight. Upon completion of the exercise routine, the exercise data may be stored on the system's memory and be available for access by the same user to access at a later time.

Figure 6:
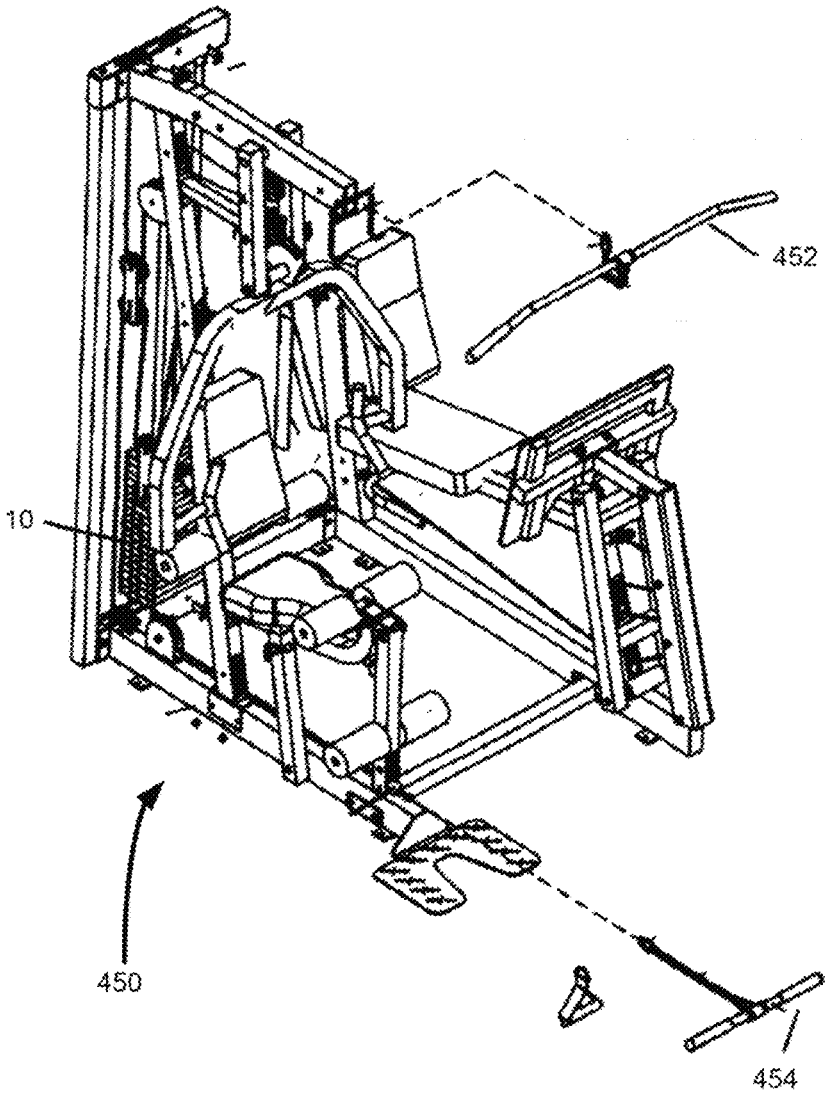
FIG. 6 is a front perspective view of an exercise device in one embodiment of the present invention.

FIG. 6 is a front perspective view of an exercise device 450 in one embodiment of the present invention. The exercise device may include the variable weight system 10. The exercise device may include an overhead user bar 452 and a lower user bar 454. The exercise device may enable a user to perform various conventional weight exercises by using the variable weight system.

Figure 7:
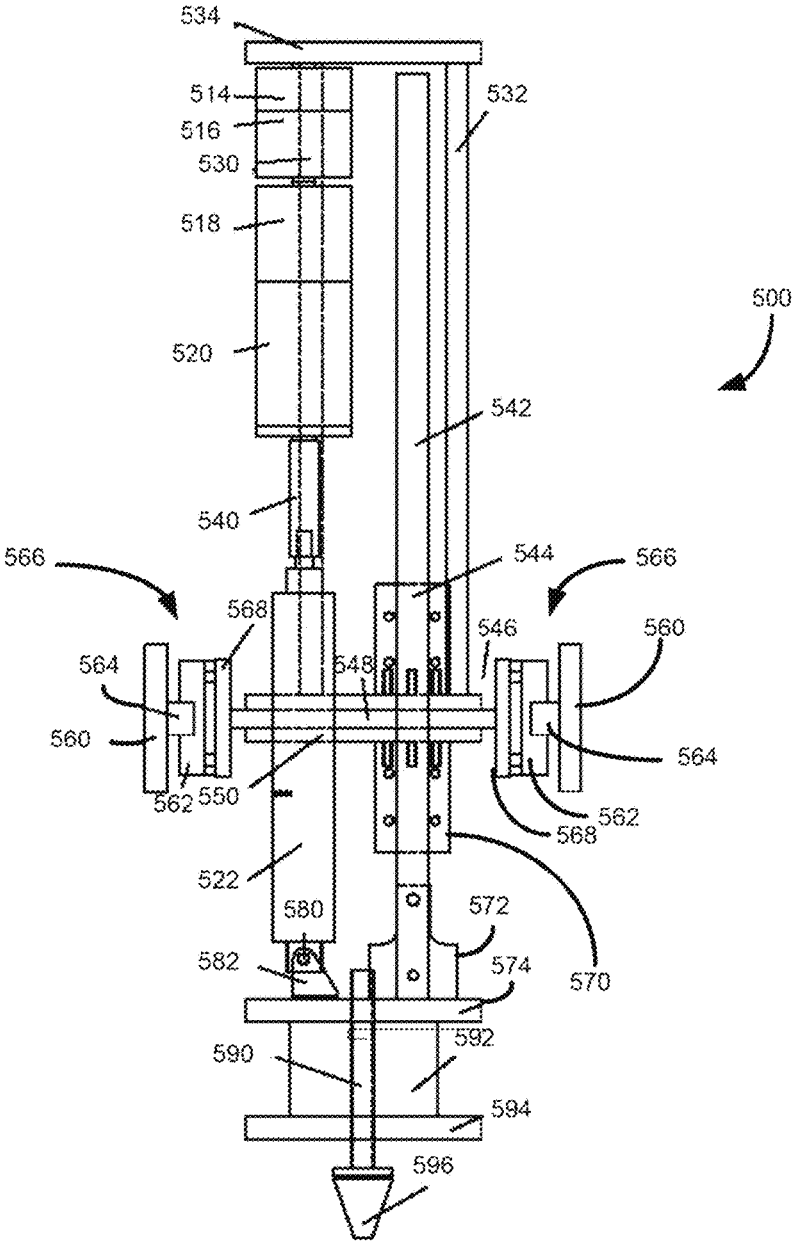
FIG. 7 is a side elevation view of a multi-cylinder system in a second embodiment of the present invention

In another embodiment, the present invention may be utilized in a variable distance system, such as for a robotic arm. In this embodiment, the present invention may utilize a plurality of cylinders for moving an object, such as a travel arm. FIG. 7 is a side elevation view of a multi-cylinder system 500 in a second embodiment of the present invention. The multi-cylinder system 500 includes a cylinder 514, operating in a Z direction of Z to the zero power, a cylinder 516, operating in the Z direction of Z to the first power, a cylinder 518, operating in a Z direction of Z to the second power, a cylinder 520, operating in a Z direction of Z to the third power, and a cylinder 522, operating in a Z direction of Z to the fourth power.

The multi-cylinder system is arranged in a substantially vertical and parallel orientation with the cylinders 514, 516, 518, 520, and 522. A key novel component of the present invention is the use of a plurality of cylinders utilizing a series of specific rations. For example, ½-inch, 1-inch, 2-inch, 4-inch, and 8-inch cylinders may be utilized to provide the full range of motion. Although inches are exemplified in the discussion above, any unit of measure may be used, such as a basic unit of measure of a centimeter, or a meter or ⅛ of an inch. The basic formula providing the ratio of dimensions for the plurality of cylinders is as follows:

$$\text{Travel distance}=\tfrac{1}{2}(x)+2^0(x)+2^1(x)+2^2(x)+2^3(x)+2^i(x)$$
$$\cdots$$

where x is the basic unit of measurement, such as one inch and i is a sequential integer for travel distances requiring greater than 8 units (e.g., eight inches).

The system 500 includes upper support bars 530 and 532 supporting an upper structure plate 534 on a lower surface 546. Between cylinders 520 and 522 is a Z direction coupler 540. Adjacent the support bar 532 is a Z direction rail bar 542. On a lower portion of the shaft 542 is a Z direction linear bearing support plate 544 and an upper structure bottom plate 546. Below the upper structure bottom plate 546 is a robot middle plate 548 and a lower structure upper plate 550. On opposite sides of the upper support bars 530 532 are X direction bearing guide rail support plates 560, X direction bearings 562, X direction bearing guides 564, X direction pneumatic cylinders 566, and X direction bearing plates 568. On a lower portion of the Z direction linear bearing support plate (upper) 544 is the Z direction linear support plate (lower) 570. Additionally, the rail bar 542 extends down to the Z direction mounting bracket 572 which is attached to a lower structure bottom plate 574. The cylinder 522 is attached to a pivot bracket 580 which is attached to a mounting bracket 582 of the bottom plate 574. A lead screw 590 may be vertically aligned between the bottom plate 574 and a gripper assembly mounting plate 594 and driven by a motor 592. The lead screw is affixed to an end effector 596 which may be actuated by a power generation mechanism, such as electrically, mechanically, vacuum, pneumatically.

The present invention, for the embodiment described for system 500, the system can reach under the base of the system and can access any point under its frame and its reach is limited by the mechanism that moves it. In the present invention, the same formula is applied. For the exercise machine, the formula is multiplied by some unit weight to provide a definitive force to exercise with. The exercise machine embodiment, through its programmable controller, can change force/weight values any time during the exercise motion without resting to change weight or stop at some arbitrary point to switch the weight/force.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A multi-cylinder system for moving a travel arm, the multi-cylinder system comprising:

a plurality of substantially vertically aligned cylinders;

a horizontal track system for moving the plurality of vertically aligned cylinders, the horizontal track system supporting the plurality of vertically aligned cylinders;

wherein each cylinder of the plurality of cylinders provides a different incremental distance for moving the travel arm, thereby providing an infinitely variable distance for moving the travel arm within a defined range;

wherein the plurality of substantially vertically aligned cylinders include:

a first cylinder having a drive stroke distance of one half of a specified unitary length;

a second cylinder having a drive stroke distance of one unitary length;

a third cylinder having a drive stroke distance of two unitary lengths;

a fourth cylinder having a drive stroke distance of four unitary lengths; and a fifth cylinder having a drive stroke distance of eight unitary lengths.

2. The multi-cylinder system of claim 1 further comprising a lead screw, the lead screw providing movement of the travel arm of a distance less than one unitary length.

3. A multi-cylinder system for moving a travel arm, the multi-cylinder system comprising:

a plurality of substantially vertically aligned cylinders;

a horizontal track system for moving the plurality of vertically aligned cylinders, the horizontal track system supporting the plurality of vertically aligned cylinders;

wherein each cylinder of the plurality of cylinders provides a different incremental distance for moving the travel arm, thereby providing an infinitely variable distance for moving the travel arm within a defined range;

wherein the plurality of cylinders include five cylinders providing a ratio defined by the formula:

$$\text{travel distance}=\tfrac{1}{2}(x)+2^0(x)+2^1(x)+2^2(x)+2^3(x)$$

where x is a unitary length and the travel distance is the desired range the travel arm may move.

* * * * *